US005209651A

United States Patent [19]

Kelleher et al.

[11] Patent Number: 5,209,651

[45] Date of Patent: May 11, 1993

[54] MULTIPLE ENGINE DEEP WELL PUMP

[75] Inventors: John M. Kelleher, La Palma, Calif.; David B. Dillon, Anchorage, Ak.

[73] Assignee: Trico Industries, Inc., Huntington Park, Calif.

[21] Appl. No.: 753,852

[22] Filed: Sep. 3, 1991

Related U.S. Application Data

[62] Division of Ser. No. 501,595, Mar. 29, 1990, Pat. No. 5,064,355.

[51] Int. Cl.[5] ..... F04B 35/02

[52] U.S. Cl. ..... 417/404; 92/151; 92/163

[58] Field of Search ..... 417/403, 404; 92/82, 92/150, 151, 163

[56] References Cited

U.S. PATENT DOCUMENTS

| | | | |
|---|---|---|---|
| 3,030,893 | 4/1962 | Shaffer | 417/404 |
| 3,168,853 | 2/1965 | Prince | 92/163 |
| 4,118,154 | 10/1978 | Roeder | 417/403 |
| 4,268,227 | 5/1981 | Roeder | 417/404 |
| 4,664,186 | 5/1987 | Roeder | 417/404 |

*Primary Examiner*—Richard A. Bertsch

*Assistant Examiner*—Michael I. Kocharov

*Attorney, Agent, or Firm*—Harris, Kern, Wallen & Tinsley

[57] ABSTRACT

A deep well pump for positioning in a bottom hole assembly and having at least one fluid pump and at least two fluid powered motors with the pump and motor pistons carried in alignment on the piston rod. The pump includes passages for delivering a power fluid to one end of each of the motor cylinders and for receiving exhaust fluid from the other end of the motor cylinders, and a valve for reversing this operation. A first sleeve is positioned around the first motor cylinder defining a power fluid path from one end of the first cylinder to one end of the second cylinder, a second sleeve is positioned around the first sleeve defining an exhaust fluid path from the other end of the first motor cylinder, and a third sleeve is positioned around the second motor cylinder defining an exhaust fluid path from the other end of the second motor cylinder, with the first and second exhaust fluid paths interconnected. When the valve reverses the operation, the power fluid paths become exhaust fluid paths and the exhaust fluid paths become power fluid paths.

6 Claims, 2 Drawing Sheets

MULTIPLE ENGINE DEEP WELL PUMP

This application is a division of application Ser. No. 07/501,595, filed Mar. 29, 1990, now U.S. Pat. No. 5,064,355.

BACKGROUND OF THE INVENTION

This invention relates to deep well pumps of the type widely used for production of oil from deeper wells. A conventional fluid operated deep well pump is shown in U.S. Pat. No. 2,081,223, and the present invention is an improvement on the pump shown in that patent.

A typical deep well pump has a fluid powered motor and a fluid pump with the motor piston and the pump piston in axial alignment on a piston rod.

A typical pump is in the order of 1.9 to 3.8 inches diameter and 6.5 to 25 feet long, and is positioned in the bottom hole assembly of the well casing. The outside diameter of the bottom hole assembly typically is in the order of 4 to 8 inches and the inside diameter of the well casing typically is in the order of 4½ to 9 inches. The pump as shown in the U.S. Pat. No. 2,081,223 has a single annular seal between the pump and the bottom hole assembly adjacent the upper end of the pump.

A pump must be removed from the well periodically for repair, including replacement of seals. The life of the pump in the field depends upon a number of factors including the nature of the fluid being handled and the operating speed.

In order to obtain more pumping power, especially for operation at greater depths, multi-engine pumps have been produced, and a typical example is shown in U.S. Pat. No. 3,653,786. In this design, two fluid powered motors are positioned one above the other with the motor pistons on the common piston rod. This dual engine configuration requires porting to the exterior of the pump to provide fluid paths around various components, resulting in a larger diameter well casing requirement thereby increasing the expense of the installation, or in a reduced diameter for the pump with a reduction in production. Also, additional annular seals are required on the exterior of the pump for the externally ported flow paths. These additional seals increase the costs of construction and of maintenance of the pumps.

Accordingly, it is an object of the present invention to provide a new and improved deep well pump having two fluid powered motors with the motor construction contained within the pump without requiring any external porting and without requiring any additional external seals.

Another object of the invention is to provide a multi-engine pump which can be used in deeper wells while using the same surface power fluid pressure and the same well casing diameter as are used with present day single engine pumps.

A specific object of the invention is to provide such a multi-engine pump which operates with internal porting and internal concentric fluid flow paths and which can easily be adapted to existing bottom hole assemblies of appropriate length.

In particular, it is an object of the invention to provide such a deep well pump configuration which can be utilized with one fluid pump or with a plurality of fluid pumps and which can be used with open power fluid path pumps and closed power fluid path pumps. The invention is not limited to a pump with two fluid powered motors, and three or more motors could be utilized. However present day design considerations indicate that the invention will most likely be utilized with only two motors.

Other objects, advantages, features and results will more fully appear in the course of the following description.

SUMMARY OF THE INVENTION

A deep well pump for positioning in a bottom hole assembly and having at least one fluid pump and at least two fluid powered motors with the pump and motor pistons carried in alignment on the piston rod. The pump includes means for delivering a power fluid to one end of each of the motor cylinders and for receiving exhaust fluid from the other end of the motor cylinders, and a valve for reversing this operation. A first sleeve is positioned around the first motor cylinder defining a power fluid flow path from one end of the first cylinder to one end of the second cylinder, a second sleeve is positioned around the first sleeve defining an exhaust fluid path from the other end of the first motor cylinder, and a third sleeve is positioned around the second motor cylinder defining an exhaust fluid path from the other end of the second motor cylinder, with the first and second exhaust fluid paths interconnected. When the valve reverses the operation, the power fluid paths become exhaust fluid paths and the exhaust fluid paths become power fluid paths.

DESCRIPTION OF THE PREFERRED EMBODIMENT

Figure 1:
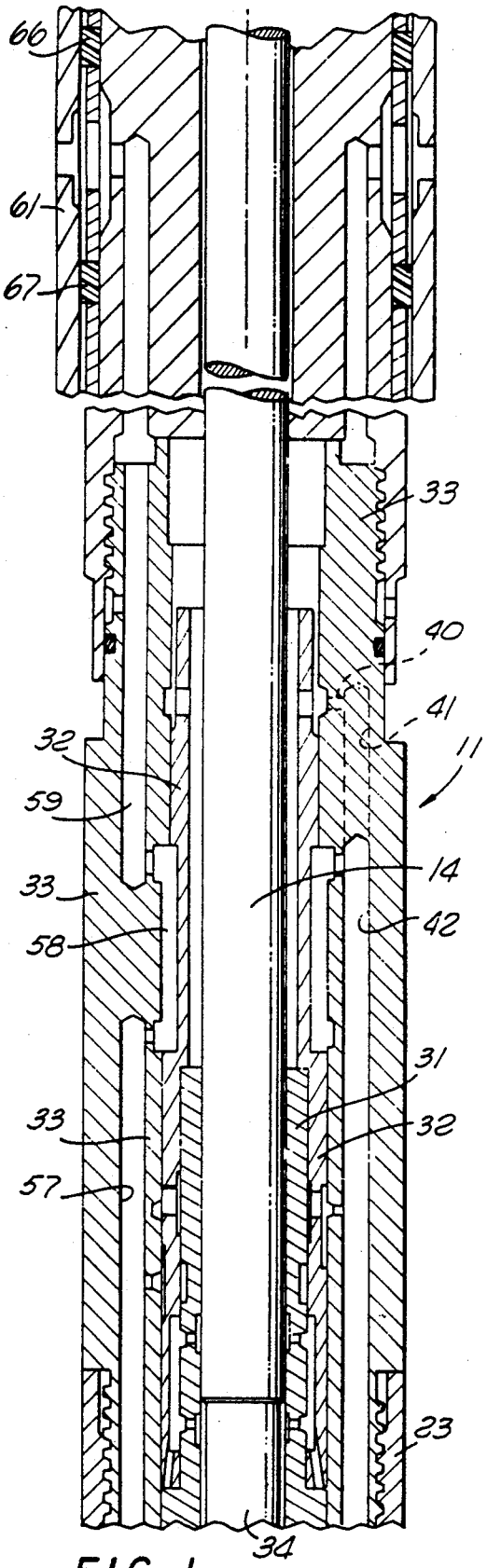
FIG. 1 is a vertical sectional view of a deep well pump incorporating the presently preferred embodiment of the invention.

The deep well pump of the present invention is an improvement on that shown in U.S. Pat. No. 2,081,223. Reference may be made to that patent and to the book *Theory and Applications of Hydraulic Oil Well Pumps* by C. J. Coberly, published by Kobe, Inc., Huntington Park, Calif. 1961 for details of construction and operation of the entire pump. The present invention is directed to an improvement in the motor arrangement and therefore only the motor or upper portion of the pump is illustrated and described.

The deep well pump as shown in FIGS. 1–4 includes a valve assembly 11, an upper motor 12, and a lower motor 13, with the motors positioned axially along a piston rod 14. The piston rod continues downward to one or more fluid pumps which are conventional in construction and operation and are not illustrated herein. Reference may be made to U.S. Pat. No. 2,081,223 for details of the lower end of the pump, with the corresponding to section line 16-16 of the U.S. Pat. No. 2,081,223.

The motor 12 includes a cylinder 18 and a piston 19, and the motor 13 includes a cylinder 20 and a piston 21. Conventional annular grooves 19*a*, 21*a* are provided in the pistons for packing (not shown). A sleeve 22 is positioned around the motor cylinder 18, and a sleeve 23 is positioned around the sleeve 22. A sleeve 24 is positioned around the motor cylinder 20. A fluid path 25 is provided between the motor cylinder 18 and the sleeve 22. Another fluid path 26 is provided between the sleeve 22 and the sleeve 23. Another fluid path 27 is provided between the motor cylinder 20 and the sleeve 24. The sleeves 23 and 24 are joined by a middle plug 28.

The valve assembly 11 is conventional in construction and operation, and includes a control sleeve 31 around the piston rod 14, with a slide valve 32 around the control sleeve and sliding in valve body 33. Relief 34 is provided on the piston rod for fluid flow past the rod, and a dash pot 36 is positioned between the valve assembly 11 and the upper motor 12.

The pump is shown in the drawing figures with the piston rod in the up position ready for a downstroke. Power fluid is pumped from the surface down the well and enters the pump at the upper end around the piston rod. The power fluid flows radially outward through passage 40 and axially downward through passage 41 and into an annulus 43 in the dash pot above the upper piston 19, moving the piston rod downward. Passage 42 provides for fluid flow from the relief 34 on the piston rod 14, upward to the valve 32 as the rod moves downward.

Figure 2:
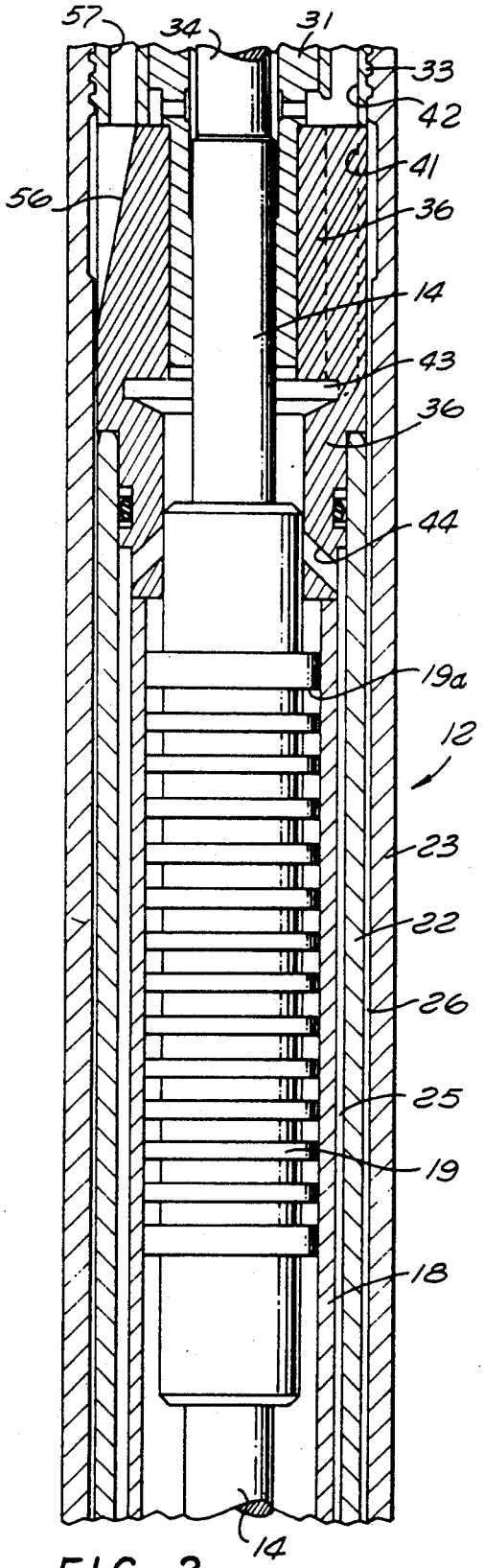
FIG. 2 is a downward continuation of FIG. 1.
Figure 3:
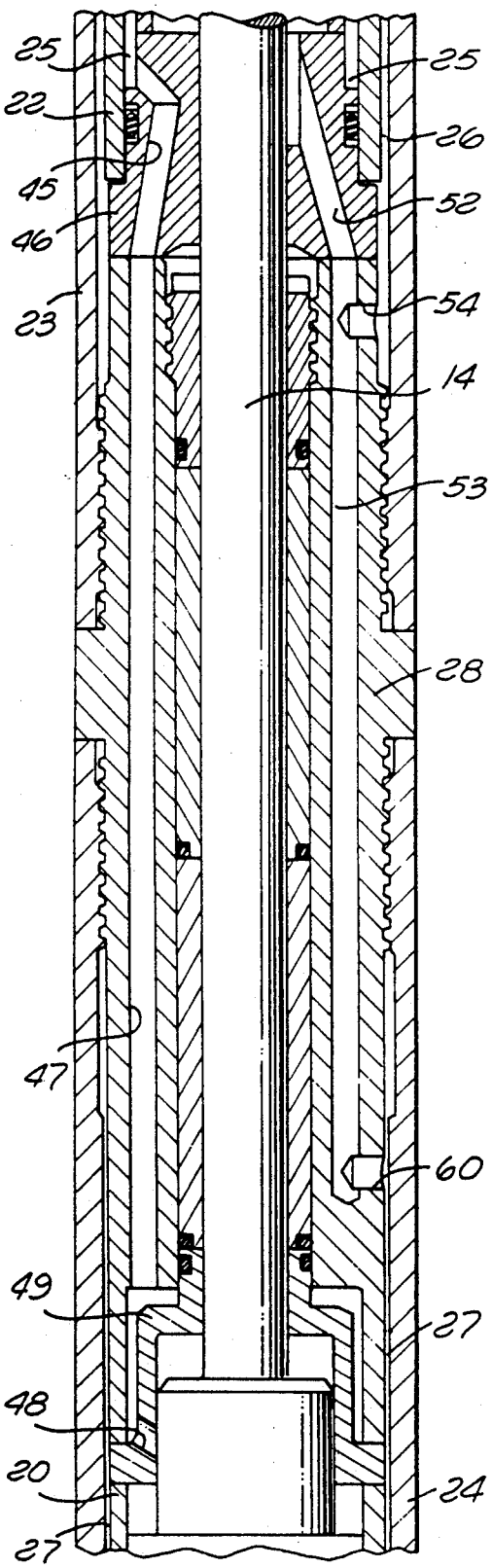
FIG. 3 is a downward continuation of FIG. 2.
Figure 4:
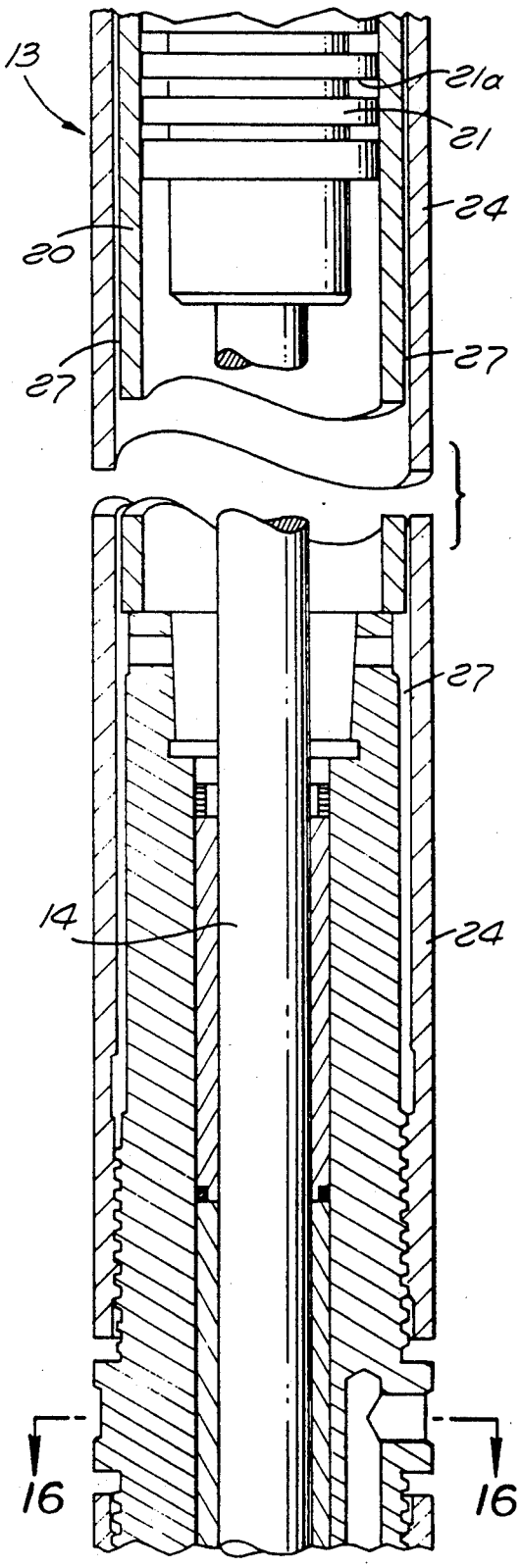
FIG. 4 is a downward continuation of FIG. 3.

As the piston moves down, power fluid flows through oblique passages 44 into the fluid path 25 around the upper motor (FIG. 2). At the lower end of the fluid path 25, power fluid flows through a passage 45 in the left portion of a member 46, through a passage 47 in the middle plug 28, and through oblique passages 48 in a dashpot 49 into the upper end of the cylinder 20 of the lower motor 13 (FIG. 3). The upper dash pot 36 provides an upper sleeve in which the piston 19 slides, and the lower dash pot 49 provides a lower sleeve in which the piston 21 slides.

During the downstroke, fluid is exhausted from the lower end Of the upper cylinder 18 through a passage 52 in the member 46 into an axial passage 53 in the middle plug 28 and through a radial passage 54 into the flow path 26 between the sleeves 22 and 23 (FIG. 3). The exhaust fluid continues to flow upward through a space 56 in the dash pot 36 into an axial passage 57 in the valve body 33, radially into and radially out of a passage 58 between the valve body 33 and slide valve 32, and upward through an axial passage 59 (FIG. 1).

Exhaust fluid from the lower end of the lower cylinder 20 flows radially outward into the fluid path 27 between the cylinder and the sleeve 24 (FIG. 4) and inward through radial passage 60 into the passage 53 in the middle plug 28, where it mixes with the exhaust fluid from the upper cylinder.

When the piston rod .reaches the lower end of the stroke, the valve assembly operates in the conventional manner to move the slide valve 32 upward which motion converts the previously described exhaust fluid paths to power fluid paths and the previously described power fluid paths to exhaust fluid paths. This reciprocating action continues moving the pump pistons downward and upward as long as the power fluid is pumped down the well from the surface.

A fitting is carried at the lower end of the pump for engagement with the bottom hole assembly. This is a conventional construction and is not shown in the drawing figures, and can be that shown in U.S. Pat. No. 2,081,223. The only other contact required between the pump and the bottom hole assembly is sealing near the upper end of the pump.

The power fluid system may be open power fluid wherein exhausted power fluid combines with produced well fluid using a common fluid path to the surface, or closed power fluid wherein exhausted power fluid remains separated from produced well fluid with the two fluids returning to the surface through separate fluid passages. An open power fluid system uses one external seal adjacent the top of the pump; a closed power fluid system uses two axially spaced seals adjacent the top of the pump. These are the conventional arrangements for the single motor pumps. One of the features of the present invention is the provision of two motors without requiring any additional external seals, in contrast to prior dual motor designs which do require additional external seals in the middle portion of the pump.

The preferred double seal arrangement for a closed power fluid system is shown in FIGS. 1 and 2, with a portion 61 of the bottom hole assembly provided in the pump adjacent the top, with an annular seal ring 64 positioned in the groove. For the closed power system version, two spaced seals 66, 67 are used in annular grooves adjacent the top of the pump. As in the prior U.S. Pat. No. 2,589,671, the exhaust fluid flows outward through an opening in the portion 61 of the bottom hole assembly and upward to the surface.

The present deep well pump construction provides a multi-engine pump for improved pumping capability while retaining the internal porting and single seal of the single engine pump and while being usable with a conventional bottom hole assembly of appropriate length. This new design is capable of operating in deeper wells while utilizing the same surface power fluid pressure and same well casing tubing diameter. The new design utilizes the internal porting of the single engine design and incorporates internal concentric flow passages resolving the problem of multi-engine configurations. The new design may be utilized with the open power fluid arrangement and the closed pump fluid arrangement as dictated by the character of the fluid being pumped.

I claim:

1. In a deep well pump having at least one fluid pump with a pump cylinder and a pump piston reciprocating in said pump cylinder and carried on a piston rod, for positioning in a bottom hole assembly for a closed power fluid system and having an inner wall, the improvement including in combination:

first and second fluid powered motors, with each of said motors having a motor cylinder and a motor piston reciprocating in the motor cylinder, with said first and second motor pistons carried on said piston rod;

first means for delivering a power fluid to one end of said first motor cylinder;

second means for delivering a power fluid to one end of said second motor cylinder;

a first sleeve positioned around said first motor cylinder defining a power fluid path between said first sleeve and said first cylinder from said one end of said first cylinder to said one end of said second cylinder;

a second sleeve positioned around said first sleeve defining a first exhaust fluid path between said second sleeve and said first sleeve from the other end of said first motor cylinder;

a third sleeve positioned around said second motor cylinder defining a second exhaust fluid path between said third sleeve and said second cylinder from the other end of said second cylinder;

coupling means interconnecting said first and second exhaust fluid paths;

annular seal groove means in the outer periphery of the pump for receiving seal ring means for sealing engagement of the pump with said bottom hole assembly inner wall at a single location;

third means for defining a third exhaust fluid path from said first and second exhaust fluid paths, said third exhaust fluid path including a path between said second and third sleeves and said bottom hole assembly inner wall, and means defining an outlet opening through said bottom hole assembly at said seal ring means in said annular seal groove means for flow of spent power fluid from said motors into a well casing, with the only seal below said seal ring means being at the lower end of said deep well pump below the fluid pump thereof, and with said annular seal groove means including a pair of annular seal grooves in the outer periphery of said first means for a pair of seal rings for sealing engagement with said bottom hole assembly inner wall at a location adjacent the top of the pump.

2. A pump as defined in claim 1 wherein said first means includes upper sleeve means with said first piston sliding therein and having means defining passages from said first cylinder to said power fluid path between said upper cylinder and said first sleeve.

3. A pump as defined in claim 2 wherein said second means includes lower sleeve means with said second piston sliding therein and having means defining passages from said power fluid path between said second and third sleeves to said second cylinder.

4. A pump as defined in claim 3 wherein said first motor cylinder includes means defining a fluid flow path from the lower end of said first motor cylinder to said coupling means to said exhaust fluid paths.

5. A pump as defined in claim 2 wherein said first motor cylinder includes means defining a fluid flow path from the lower end of said first motor cylinder to said coupling means to said exhaust fluid paths.

6. A pump as defined in claim 1 wherein said first means includes control valve means for changing said exhaust fluid paths to power fluid paths and said power fluid paths to exhaust fluid paths.

* * * * *